United States Patent [19]

Gressman

[11] 4,009,626

[45] Mar. 1, 1977

[54] VARIABLE ROTARY CUTTER

[76] Inventor: Richard H. Gressman, 37342 Glenbrook Ave., Mt. Clemens, Mich. 48043

[22] Filed: July 9, 1975

[21] Appl. No.: 594,294

[52] U.S. Cl. ..... 83/116; 83/162; 83/346; 83/522; 83/699

[51] Int. Cl.[2] ..... B26D 1/36; B26D 1/40

[58] Field of Search ..... 83/116, 304, 305, 346, 83/165, 162, 522, 699

[56] References Cited

UNITED STATES PATENTS

| | | | |
|---|---|---|---|
| 1,007,721 | 11/1911 | Meyer | 83/116 |
| 1,738,076 | 12/1929 | Molins | 83/116 |
| 2,496,468 | 2/1950 | Hanson | 83/116 |
| 3,570,348 | 3/1971 | Hallden | 83/305 X |
| 3,606,811 | 9/1971 | Hallden | 83/305 |
| 3,768,801 | 10/1973 | Maynard et al. | 83/346 X |

*Primary Examiner*—Frank T. Yost
*Attorney, Agent, or Firm*—Willis Bugbee

[57] ABSTRACT

Upper and lower combined cutting and anvil rolls are provided with axially-extending circumferentially-spaced grooves for receiving compression cutting blades clamped therein, with their cutting edges substantially engaging the anvil portions of the other roll. One roll is drivingly connected to the other roll by intermeshing helical gears whereby one roll can be shifted axially and thereby simultaneously shifted circumferentially relatively to the other roll in order to vary the circumferential spacing of the cutting blades of the upper and lower rolls so as to vary the lengths of the sheets cut from a web of paper emerging from a printing press by which the pages have been printed. An adjusting screw shaft engages the upper roll through a thrust bearing and is equipped with a hand wheel and lock nut wheel to shift the roll axially and lock it in position. Registering concentric annular dials between the upper axially-adjustable roll and its helical drive gear indicate the adjustment which may be obtained. A cam device on the lower roll registers with ejector bars adjacent the cutting blades to eject the trim or scrap left over when the lengths of the pages cut total less than the circumference of the roll. On both the upper and lower rolls are mounted compression cutting blades, each roll acting not only as a cutting roll but also as a rotary anvil roll for the cutting blades of the other cutting roll.

8 Claims, 4 Drawing Figures

VARIABLE ROTARY CUTTER

BACKGROUND OF THE INVENTION

Certain prior rotary cutting machines have an upper cutting roll with circumferentially-spaced radial cutting blades engaging a lower anvil roll with a smooth cylindrical surface. The web of printed paper from a printing press is fed by feed rollers between these cutting rolls to be cut into pages. This construction requires the rotary cutting machine to be shut down during the adjustment of the cutting blades from one cutting location to another to adapt it to the cutting of different sizes of pages for different jobs. Such "down time" necessitates the costly idleness of eight press men, for example, as well as delay time in turning and producing one job to producing another job of different sheet or page dimensions.

PROBLEMS SOLVED BY THE PRESENT VARIABLE ROTARY CUTTER

The present invention rotary cutter severs sections of predetermined lengths from an elongated paper web emerging from a previous processing machine, such as a color printing press. Where the product is a catalogue or magazine, for example, with illustrations of several colors, the pigments from adjacent illustrations tend to overrun their boundaries, which are therefore not sharp. This overrun is known as bleeding. The first problem solved by the present rotary cutter is to cut off a strip between adjacent illustrations so as to remove the fuzzy boundaries resulting from the bleeding. This first cut is therefore called a "bleed cut".

The second problem solved by the present rotary cutter is to make a so-called "gap cut". This gap cut removes a strip which is aligned with the gap between adjacent printing plates on the printing press cylinder. This gap results from the necessary presence of the clamps for clamping these printing plates to the periphery of the printing press cylinder. The cutting of this non-imprinted strip is called the gap cut, and with the bleed cut constitutes the scrap or so-called waste trim.

The third problem solved by the present rotary cutter is to make the cuts, other than the bleed cut and gap cut, for severing pages or portions of different lengths resulting from different sizes of product, such as magazines, books or catalogues, and such cuts usually have to be made at several places around the cutter cylinders. The present rotary cutting machine has its cutting blades adjustable relatively to the circumference of the cutting cylinder or cylinders, so as to cut short or long pages from the paper web emerging from the printing press. The final cut severs a scrap or "waste" strip whose length depends upon the job.

SUMMARY OF THE INVENTION

The present variable rotary cutter solves these problems by providing a machine wherein the upper rotary cutting roll cylinder can be precisely shifted circumferentially relatively to the lower cutting roll cylinder from cutting one length of sheet to cutting a different length of sheet, all without stopping the machine. Each cutting roll serves as an anvil for the cutting blades of the other cutting roll. Ejector blades in the lower roll are movable radially relatively to their respective adjacent cutting blades to eject the trim or scrap strips or sheets of paper which would otherwise tend to adhere to the roll, and forces them downward into a trim exhaust duct.

Figures 1, 4:
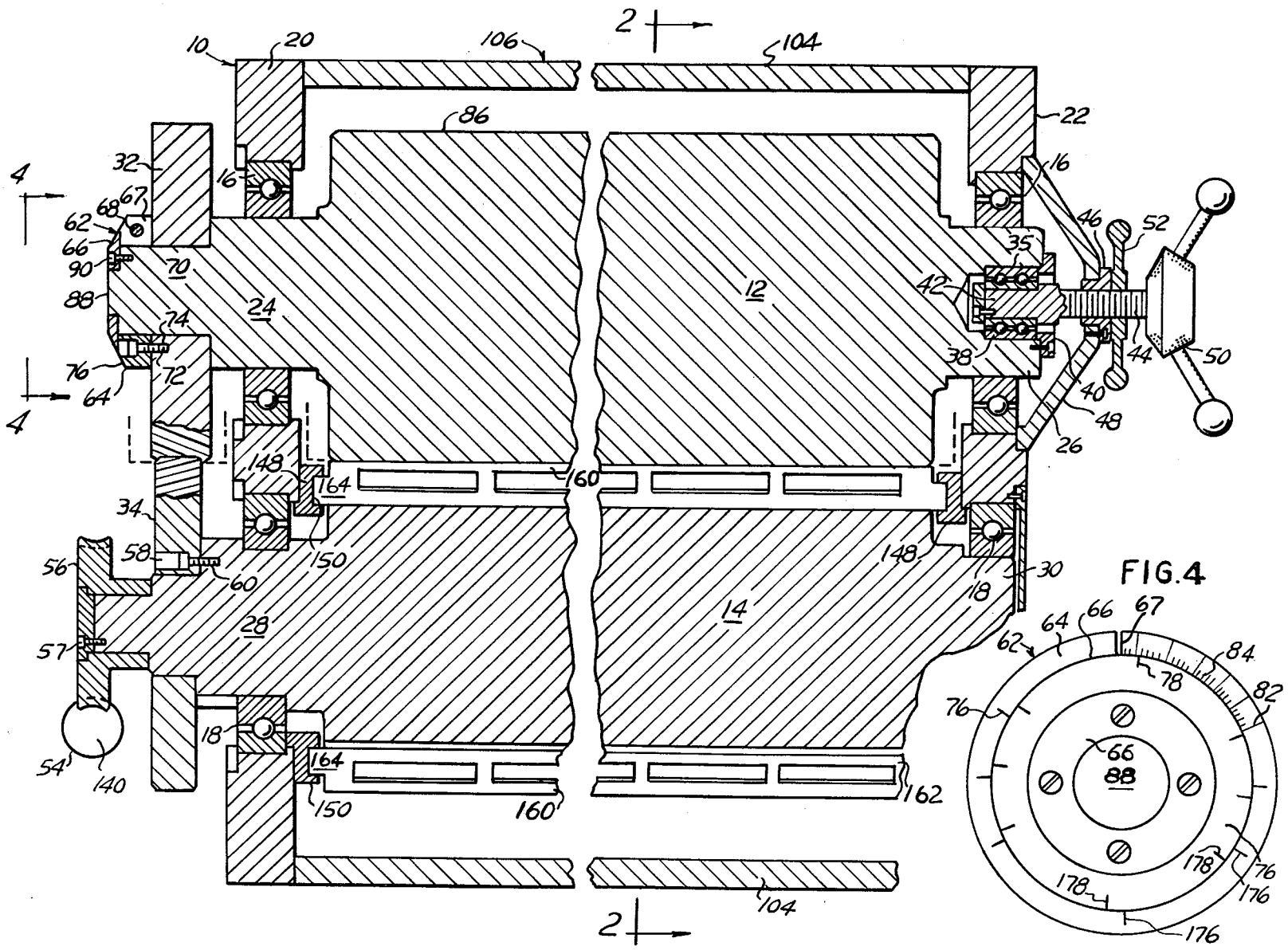
FIG. 1 is a central vertical axial section through a variable rotary cutter, according to a preferred form of the invention, with the midportions of the machine broken away to conserve space.
FIG. 4 is a fragmentary end elevation of the graduated cooperating adjusting dials shown in the upper left-hand corner of FIG. 1.

Referring to the drawings in detail, the variable rotary cutter, generally designated 10, of the present invention has upper and lower rotary combined cutting and anvil rolls 12 and 14 mounted in bearings 16 and 18 respectively, which in turn are stationarily mounted in frame structures 20 and 22 respectively, so that the upper roll shaft portions 24 and 26 and the lower shaft portions 28 and 30 are rotatably supported. The upper and lower shaft portions 24 and 28 are drivingly interconnected by helical gears 32 and 34, the upper helical gear 32 being adapted to be adjustably moved axially independently by mechanism shown in the upper left-hand corner of FIG. 1. The shaft portion 26 contains a socket 35 within which is located a twin row ball thrust bearing 38. Rotatably mounted in this ball thrust bearing 38, which is held in the socket 35 by a retainer ring 40, is the reduced diameter smooth portion 42 of an upper roll adjusting screw 44. The upper roll adjusting screw 44 is threaded through a flanged nut 46 mounted in a frustoconical bracket or end member 48. The adjusting screw 44 has on its outer end a hand wheel 50 by which it may be rotated for adjustment purposes, and locked in its adjusted position by a lock nut hand wheel 52 threaded onto the screw 44 against the flanged nut 46.

The lower helical gear 34 is driven by a motor-driven worm 54 and worm gear 56 which meshes therewith and is bolted at 57 to the shaft portion 28. The lower helical gear 34 is drivingly connected to the lower roll end portion 28 by a drive screw 58 passing through the gear 34 and the lower roll 14.

To vary the phase relationship of the upper roll 12 and its cutters relatively to the lower roll 14 and its cutters (FIGS. 2 and 3), the upper roll shaft portions 24 and 26 and upper helical gear 32 are mounted for adjustable rotation relatively to the lower helical gear 34 by the adjustment measurement indicating device 62 shown in the upper left-hand corner of FIG. 1 and in FIG. 4.

The adjustment device 62 (FIGS. 1 and 4) includes coaxial outer and inner annular dials 64 and 66, the outer dial 64 of which is split radially at 67 and provided with a clamping screw 68 whereby the split ring-like dial 64 may be either tightly clamped to the reduced diameter end portion 70 of the upper roll shaft portion 24, or released so as to be rotated relatively thereto. The outer dial 64 is drilled, and the upper helical gear 32 threaded axially at 72 (FIG. 1) to receive drive screw or screws 74. The inner dial 66 has a bevelled annular face 76 with an index mark or pointer 78 (FIG. 4). The outer cylinder dial 64 has a bevelled annular face 82 marked off in graduations 84 (FIG. 4) corresponding to inches around the cylindrical periphery 86 of the upper roll 12. The inner dial 66 is mounted on the end 88 of the still-further-reduced end portion 70 of the upper roll shaft portion 24 and is drilled, and the shaft portion 70 drilled and threaded to receive drive screws 90. Thus, during operation, by reason of the helical gears 52 and 54, and without stopping the machine, the upper roll 12 may simultaneously be adjustably moved axially and adjustably rotated circumferentially relatively to lower roll 14 by the adjusting screw 44 and its hand wheel 50.

Figure 2:
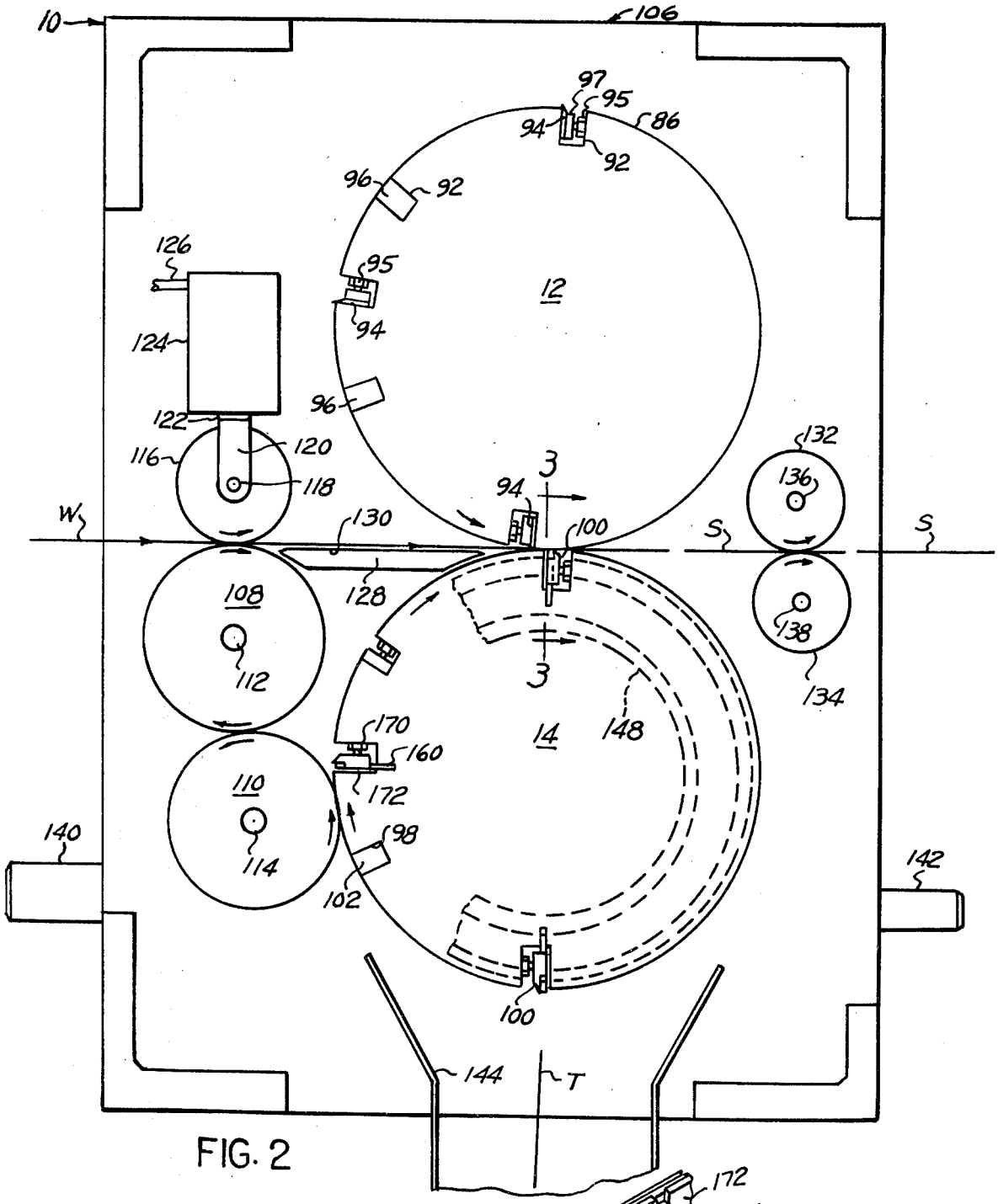
FIG. 2 is a vertical cross-section taken along the line 2—2 in FIG. 1.

Referring now to FIG. 2, the upper roll 12 is provided with axially-elongated cutter grooves 92 into which elongated cutting blades 94 are inserted and clamped by bolts 95 in threaded blocks 97 in a conventional way not forming a part of the invention. The grooves 92 not required for cutters are provided with similarly-shaped elongated filler bars 96. The lower roll 14 is similarly provided with grooves 98, certain of which contain cutters 100, while others contain filler bars 102. The spacing of the circumferentially-spaced radial grooves 92 and 98 depends upon how many product sheets are to be cut per revolution of the rolls 12 and 14.

The frame structures 20 and 22 in which the bearings 16 and 18 are mounted are interconnected by cross members 104, this assembly constituting the variable cutter frame, generally designated 106. The bearing 18 at the opposite end of the frame 104 from the ball thrust bearing 38 is preferably a single row angular contact bearing which absorbs the thrust of the helical gear 34.

The incoming web W, such as a printed paper web emerging from a printing press, is fed to the cutting rolls 12 and 14 by an infeed roll 108 which is driven in the direction of the arrows (FIG. 2) by a rotary idler 110 which in turn is drivingly connected to the lower cutting roll 14 so as to rotate in timed relationship therewith. The infeed roll 108 and rotary idler 110 are mounted on shafts 112 and 114 respectively journaled in the frame 106. The web W is pressed against the infeed roll 108 by a pressure roll 116 rotatably mounted on a shaft 118 which in turn is mounted in a yoke 120 connected to the piston rod 122 of an air cylinder 124 which in turn is supplied with compressed air through a conduit 126 near the upper end of the cylinder 124. It is frequently found desirable to offset the yoke 120 laterally relatively to the piston rod 122 so as to provide a caster effect upon the infeed roll 116.

The web W inwardly of the infeed roll 108 passes across a supporting plate 128, the upper surface 130 of which defines a portion of the web path through the machine. Beyond the cutting rolls 12 and 14 the sheets or pages S severed thereby from the web W pass between and are guided and driven between outfeed rollers 132 and 134 rotatably mounted on shafts 136 and 138 respectively. An infeed shaft 140 journaled in the frame 106 rotates the worm 54 to drive the variable rotary cutter 10, whereas a rotary outfeed shaft 142 drives the outfeed rolls 132 and 134 through their respective shafts 136 and 138, whereas the scrap or trim pieces T resulting from the excess sheet material left over per revolution of the cutting rolls 12 and 14 is ejected in the manner described below and falls through a trim chute 144 in the bottom part of the variable rotary cutter 10.

Figure 3:
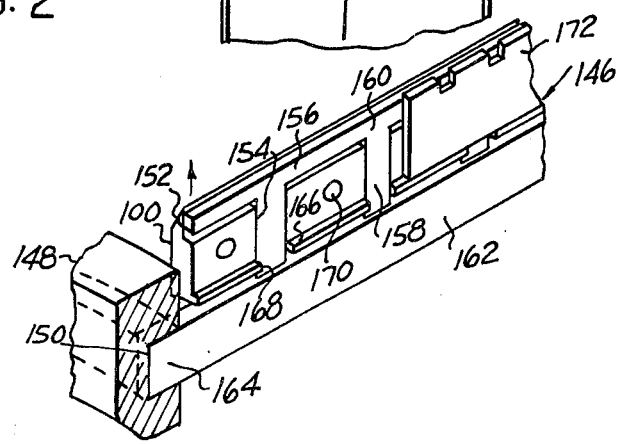
FIG. 3 is a perspective view of one of the lower roll cutting blades and its associated trim ejector bar actuated by the cam shown in part at the lower left-hand end of the Figure.

Positive ejection of the waste or trim pieces T is effected by the ejection mechanism, generally designated 146, shown in FIG. 3, thereby avoiding the occasional adhesion of the trim pieces T to the lower anvil roll frequently occurring in prior rotary cutters, where reliance was made upon compressed air to bring about such ejection. Positive ejection in the present variable rotary cutter is brought about by a pair of spaced stationary cams or eccentrics 148 fixedly secured to the frame structures 20 and 22 in the lower right-hand and left-hand corners in FIG. 1 and containing annular eccentric cam grooves 150. The lower cutting blades 100 are slotted or rabbeted at 152 (FIG. 3) and grooved at 154 to receive the circumferential and radial portions 156 and 158 respectively of ejector bars 160 of I-shaped construction with the lower bar portion 162 having opposite end projections 164 shaped to slidably engage the annular eccentric cam grooves 150. Each cutting blade 100 along its rearward or blunt edge is provided with guide rib sections 166 with gaps 168 between the ends thereof for the passage of the radial portions 158. Each cutting blade 100 is drilled and threaded to receive clamping bolts 170 (FIG. 2). A cover plate 172 with spaced notches 174 along its upper edge covers the ends of the clamping bolts 170 and also the radial portions 158 of the ejector bars 160.

Prior to setting up the variable rotary cutter 10 of this invention, the clamping bolts 95 and 170 are slightly loosened. The cutting blades 94 and 100 are then moved outward in their respective grooves 92 or 98 until their cutting edges precisely engage the anvil portions extending circumferentially between said grooves 92 and 98 while their respective opposite rolls 12 or 14 are rotated sufficiently to do so, as shown in the center of FIG. 2. The clamping bolts 95 and 170 are then firmly tightened to lock the cutting blades 94 and 100' in their thus-adjusted compression-cutting positions.

In the setting up of the variable rotary cutter 10 of this invention, to cut predetermined sheets or pages S from the web W, the operator makes an initial coarse adjustment by loosening the tangent screw 68 in the upper left-hand corner of FIG. 1, thereby declutching the outer annular dial 64 from the end portion 70 of the upper roll 12 and consequently disengaging the upper helical gear 32 therefrom. This releases the upper cutting roll 12 for free manual rotation. The operator then rotates the upper cutting cylinder 12 manually relatively to the helical gear 32, thereby rotating the graduated outer dial 64 relatively to the index mark or pointer 78 on the inner annular dial 66 by the desired amount, as indicated by the single index line or pointer 78 on the graduated scale 84, (The pairs of index lines 176 and 178 on the dials 64 and 66 represent the relative positions of the cutting blades 94 and 100 on rolls 12 and 14.) The operator then retightens the tangent screw 68 to reclamp the upper cutting cylinder 12 to the helical gear 32, thereby clutching the helical gear 32 to the reduced diameter end portion 70 of the upper cutting roll 12. This adjustment changes the difference in the length of the sheet or page to be cut, as well as the length of trim as required between illustrations or between sheets. If, for example, the trim is to be five-sixteenths of an inch, this amount is set by the indication of the index pointer 78 upon the graduated scale 84 during the above manual adjustment.

The operator now starts the machine and observes the circumferential length of the output trim. If this is what is desired, no further adjustment is needed; if not, he loosens the lock nut hand wheel 52 and rotates the running adjustment hand wheel 50 which shifts the upper roll 12 axially while it is running, so that it slides axially in its bearings 16 in response to rotation of the adjusting screw shaft 44 by the running adjustment hand wheel 50. Thus, the fine adjustment can be made while the machine is running.

I claim:

1. A variable rotary cutter for cutting sheets of predetermined lengths from an elongated web of sheet material moving therepast, said cutter comprising a frame, a pair of substantially cylindrical cutting rolls rotatably mounted in said frame upon parallel axes of rotation and having peripheries disposed in close proximity to one another and defining a web path therebetween, each of said rolls having secured to its periphery a plurality of axially extending straight cutting blades mounted thereon parallel to the axis of rotation thereof in circumferentially-spaced parallel relationship and having thereon anvil portions extending between said cutting blades with the cutting edges of the cutting blades of each roll substantially engaging the anvil portions of the other roll in compresssion-cutting relationship therewith, each of said rolls having a helical gear drivingly connected thereto, each helical gear being disposed in meshing engagement with the other helical gear, certain of the cutting blades of each cutting roll coacting with the anvil portions of the opposite cutting roll to compression-cut the opposite ends of workpiece sheets of predetermined circumferential lengths from the web passing therebetween, and means operable during rotation of said cutting rolls for adjustably moving one of said helical gears axially relatively to the other helical gear and thereby adjustably rotating one of said cutting rolls relatively to the other cutting roll and consequently varying the circumferential spacing of the straight cutting blades of said one cutting roll relatively to the straight cutting blades of said other cutting roll whereby during operation to adjustably vary the circumferential lengths of the workpiece sheets cut from the web between said straight cutting blades of said cutting rolls.

2. A variable rotary cutter, according to claim 1, wherein each helical gear is disposed adjacent one end of its respective cutting roll and is connected directly to said one end of said respective cutting roll.

3. A variable rotary cutter, according to claim 1, wherein means is provided for selectively drivingly connecting and disconnecting the axially-movable cutting roll relatively to its respective helical gear.

4. A variable rotary cutter, according to claim 3, wherein said means comprises a clutching device adjustable for selective driving engagement and disengagement of said respective helical gear with an adjacent portion of said axially-movable cutting roll.

5. A variable rotary cutter, according to claim 4, wherein there is provided a pair of adjacently-mounted graduated measuring indicators, one of said indicators being drivingly connected to said axially-movable cutting roll and the other indicator being drivingly connected to said respective helical gear.

6. A variable rotary cutter, according to claim 5, wherein said indicators comprise concentric dials, one of said dials being graduated in accordance with the circumferential dimensions of the periphery of one of said cutting rolls and the other dial having an index pointer thereon registering with the graduated dial.

7. A variable rotary cutter, according to claim 1, wherein there are provided a threaded bore in said frame, a screw shaft threaded through said threaded bore, an antifraction bearing connection between said screw shaft and said axially-movable cutting roll, and an adjusting handle connected to said screw shaft remote from said antifraction bearing connection.

8. A variable rotary cutter, according to claim 1, wherein one of said cutting rolls has radially-movable scrap-ejector members mounted in the periphery thereof adjacent its respective cutting members, wherein cam means is disposed between said frame and said one cutting roll for actuating said scrap-ejector members in timed relationship with the rotation of said one cutting roll, wherein said cutting rolls are disposed one above the other, wherein said one cutting roll is the lower cutting roll, and wherein a scrap receiver is disposed beneath said lower cutting roll in receiving position for the scrap ejected by said scrap-ejector members.

* * * * *